United States Patent [19]

Benson

[11] 4,317,249

[45] Mar. 2, 1982

[54] DEVICE FOR CLEANING CONTAINERS

[75] Inventor: Donald G. Benson, Pittsburgh, Pa.

[73] Assignee: Benson Industries Inc., Bethel Park, Pa.

[21] Appl. No.: 185,148

[22] Filed: Sep. 8, 1980

[51] Int. Cl.[3] ..... A46B 5/06

[52] U.S. Cl. ..... 15/213

[58] Field of Search ..... 15/164, 165, 213

[56] References Cited

U.S. PATENT DOCUMENTS

| | | | |
|---|---|---|---|
| 180,080 | 7/1876 | Van Drezer | 15/213 X |
| 705,983 | 7/1902 | Volckening | 15/213 X |
| 856,160 | 6/1907 | Kerouse | 15/165 |

FOREIGN PATENT DOCUMENTS

| | | | |
|---|---|---|---|
| 51787 | 6/1910 | Switzerland | 15/213 |

*Primary Examiner*—Robert L. Bleutge
*Attorney, Agent, or Firm*—Paul Bogdon

[57] ABSTRACT

An expandable and collapsible device for cleaning the internal surfaces of containers, such as glass coffee containers of the type used with coffee makers, is disclosed. The device includes a plurality of resilient strip elements shaped and arranged with respect to each other such that the upper sections define a generally cylindrical pattern while the lower sections define a bubble-like pattern. The strip elements are capable of being collapsed or compressed sufficiently to permit entry into a container. Also, the strip elements are expandable when a downwardly directed force is applied, such that the lower portions of the elements engage the bottom, lower section, and neck portion of the container. Means are provided for applying an upwardly directed force to the strip elements such that the lower sections of the elements will expand radially outwardly and upwardly to engage the upper section of the containers. Locking means are also provided for locking the elements in a desired expanded orientation permitting the device to be rotated to clean the interior surfaces of the container. Any desired type of scouring or wiping material may be secured to the lower sections of the strip elements.

7 Claims, 6 Drawing Figures

3
44
26
40
24
24
10
30
30
30
30
40
20
22
22
22
22
3

26
46
48
40
44

DEVICE FOR CLEANING CONTAINERS

BACKGROUND OF THE INVENTION

This invention relates to a device for cleaning the interior surfaces of containers, such as, but not limited to, glass coffee containers of the type used with coffee making machines. Such coffee containers are generally spheroidal in shape with a narrow neck section at the upper pouring opening.

Coffee containers of the type described above and other aesthetically or functionally odd-shaped containers, such as vases, decanters, carafes, and the like, are usually very difficult to interiorally scrub or wipe clean. In many of these kinds of containers, the pouring opening is small and a hand cannot fit through for cleaning. Thus, a scrubbing device must be used for cleaning the interior. However, all known scrubbing devices are limited in their ability to clean all of the interior surfaces mainly because the shapes of the containers are such that the devices are not designed to reach all of the surfaces. For example, because of the spheroidal shape of coffee containers, the known scrubbing devices are unable to reach the upper sections of the containers. As a result, the upper sections of the containers are not adequately clean and sometimes not cleaned at all. Accordingly, a need has existed for a device which is capable of efficiently cleaning the interior surfaces of odd-shaped containers. The cleaning device of this invention satisfies that need.

DESCRIPTION OF THE INVENTION

This invention has the capability of efficiently cleaning the entire interior surfaces of odd-shaped containers. Typical of such containers as the coffee container described hereinabove. It is to be distinctly understood, however, that the device of this invention is not limited to use in cleaning only coffee containers. At this point it is also noted that the illustrative container described herein is stated to have a spheroidally shaped main vessel. The use of the term spheriodial for the shape of the vessel is intended to include the many other shapes of vessels commonly used, therefore the use of the term spheroidal in this specification, and especially in the claims, is not to be construed as being limited to that precise geometric configuration. With that understood, this invention relates to a device for cleaning containers having an upper opening and neck sections, and an enlarged generally spheroidally shaped main vessel, the device comprising: a plurality of elongated resilient strip elements the lower sections of which being longitudinally curved and the upper sections being generally straight, the strip elements being constructed and arranged with respect to each other such that their respective upper sections form a generally tubular pattern and the lower sections form a generally bubble-shaped pattern; scouring or wiping means on the outer surfaces of the lower portions of the strip elements; securing means for securing the upper sections of the strip elements in the generally tubular pattern; holding means for fixing the lower ends of the strip elements and for holding the lower sections of the strip elements in the generally bubble-shaped pattern; force exerting means operable between the upper and lower sections of the strip elements for transmitting an upwardly directed force on the lower sections to expand the top portions of the lower sections in a radially outwardly and upwardly direction; and locking means for locking the force exerting means in differing positions relative to the upper sections of the strip elements. The strips elements, securing means, holding means, force exerting means, and locking means are all constructed and arranged with respect to each other such that the lower sections of the strip elements will compress radially inwardly to allow entry thereof into a container and when a downwardly directed force is applied to the strip elements the lower sections expand radially outwardly to engage the neck section, bottom surface, and at least the lower section of the main vessel, and when an upwardly directed force is transmitted through the force exerting means to the lower sections of the strip elements the top portions of the lower sections expand radially outwardly and upwardly to engage the upper portions of the vessel, with the force exerting means being securable to the locking means for holding the strip elements in any desired pattern within the vessel so that the device may be rotated to clean the interior of the container.

Various advantages, details and modifications of the present invention will become apparent as the following description of a certain preferred embodiment proceeds.

DESCRIPTION OF THE DRAWINGS

In the accompanying drawings I show a certain present preferred embodiment in which.

DESCRIPTION OF A PREFERRED EMBODIMENT

Figures 1, 4:
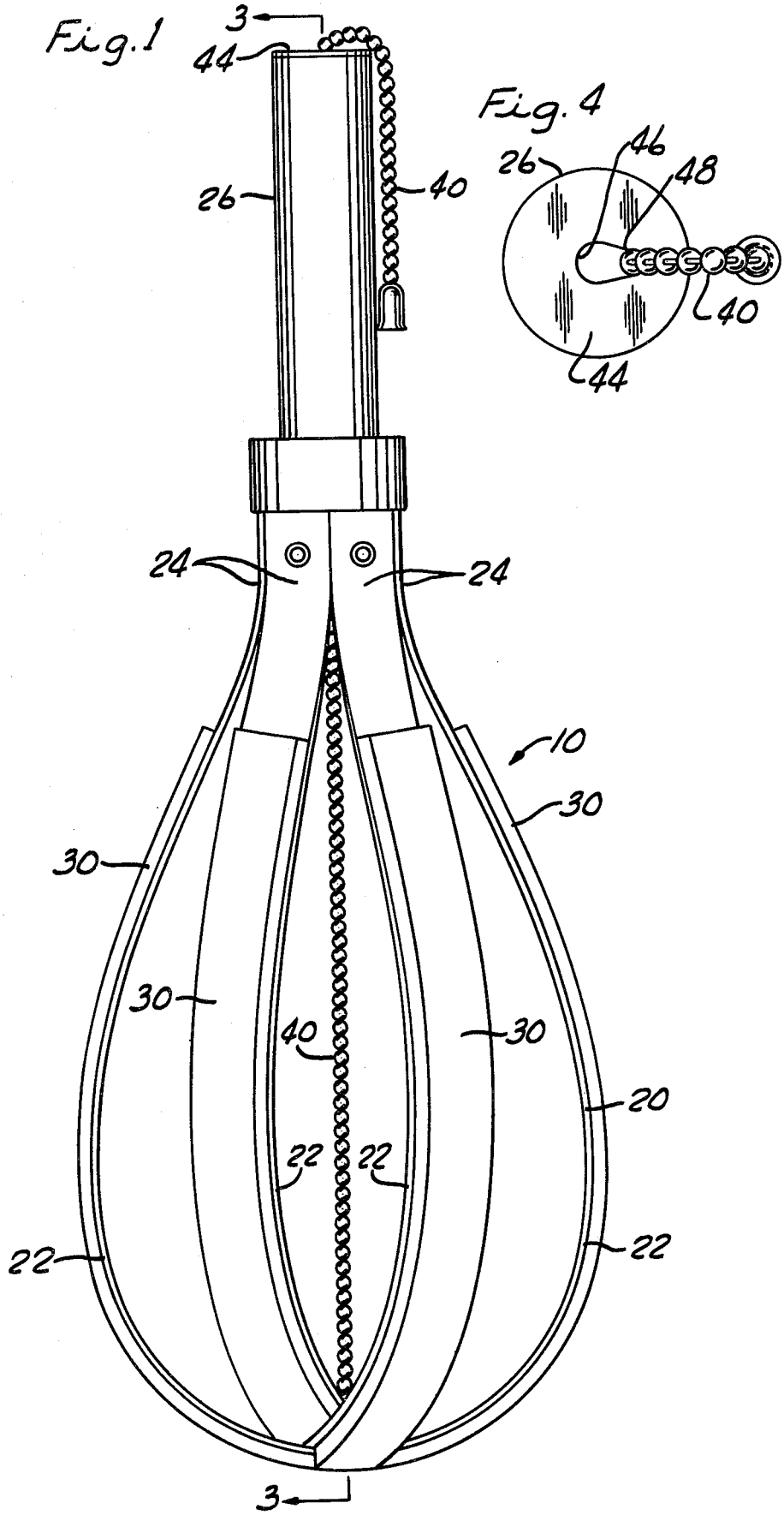
FIG. 1 is an elevation view of a device for cleaning containers embodying the present invention.
FIG. 4 is an enlarged end view of the upper end of the device of FIG. 1.
Figure 3:
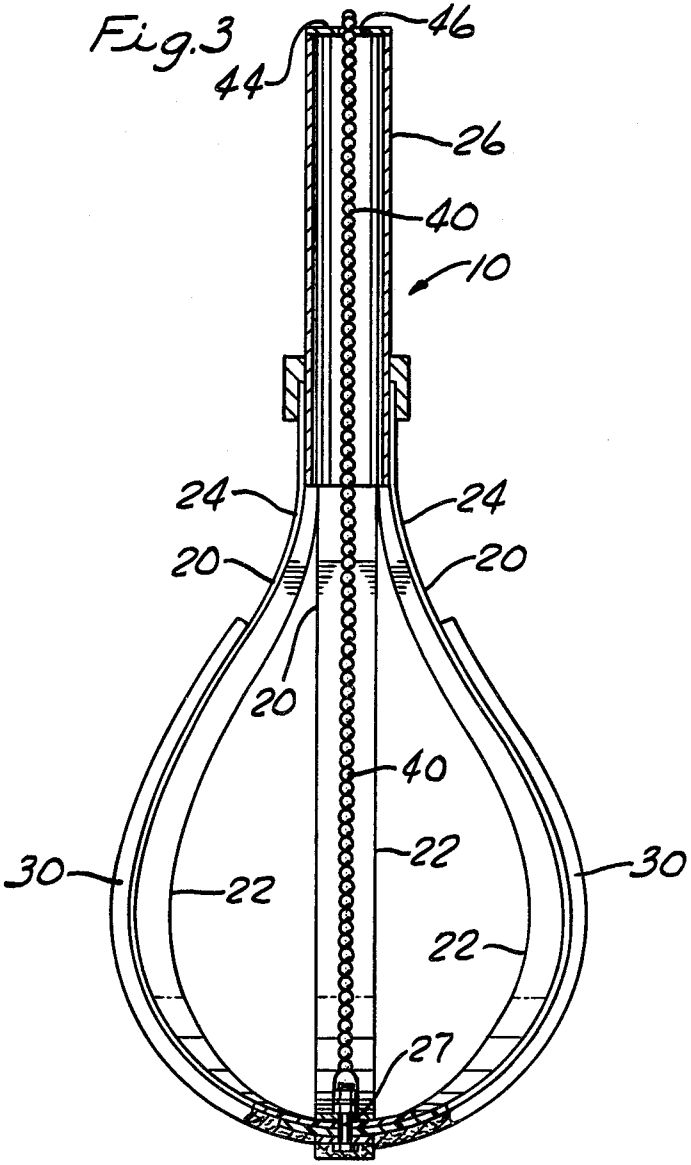
FIG. 3 is a view along the line III—III of FIG. 1.
Figure 2:
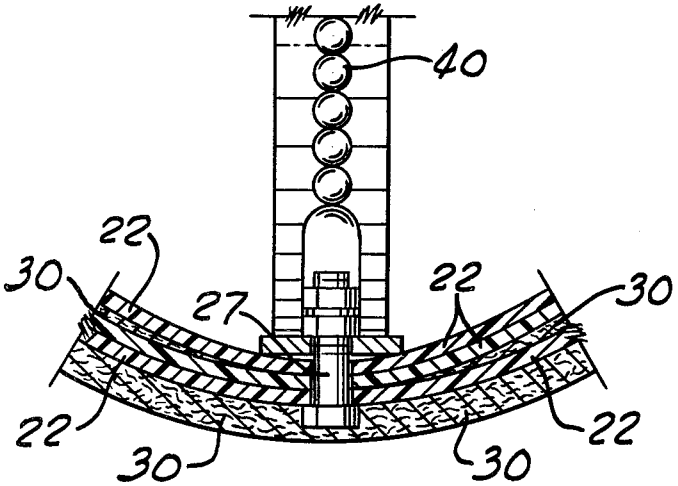
FIG. 2 is an enlarged partial sectional view showing the interconnection of the lower end sections of the strip elements forming part of this invention.

Referring now to the drawings, 10 generally represents a device for cleaning the interior surfaces of a container such as the coffee container 12 which includes a spheriodally shaped main vessel 14 and an upper pouring opening and neck section 16. The device 10 includes a plurality of elongated strip elements 20 formed from a resilient material such as a suitable plastic or the like. The lower sections 22 of the strip elements 20 are curved longitudinally outwardly to form a bubble shaped pattern as shown while the upper sections 24 of the strip elements are generally straight. The strip elements 20 are arranged in the pattern shown where the upper sections 24 are secured in a tubular cylindrical pattern by rivets or the like to the wall of a tubular handle 26. The lower portions of the lower sections 22 of the strip elements are overlapped and secured to each other by a screw 27 or the like to hold the bubble shaped pattern of the lower sections 22 in place. At this point it should be noted that the pattern of the lower sections 22 of the strip elements could be other than what is illustrated, as for example a generally right cylindrical pattern. Thus, the categorization of the pattern as being "bubble shaped" is meant to include all reasonable shapes adaptable to the essence of this invention as it pertains to the lower sections 22 of the strip elements 20. Abrasive scouring strips 30 are secured as by gluing to the lower sections 22 of the strip elements 20. It is to be noted at this point that sponge-like wiping material could be used instead of abrasive material. Also, the material selected for the strip elements 20 could have an abrasive or wiping property eliminating the need for distinct scouring or wiping strips. Thus, reference to the expression scouring means in the claims hereof is used to include an abrasive or wiping material whether separate from the strip elements 20, or inherent, as a property of the material forming the strip elements.

An elongated ball-type chain 40 is disposed to extend axially within the confines of the strip elements 20, with one end of the chain being suitably secured to the screw 27 while the other end extends outwardly of the upper end of the handle 26. The upper end of the handle 26 is provided with a plate 44 which has a central opening 46 with a smaller diameter detent 48 extending radially from the opening. The balls of the chain 40 are sized small enough to pass easily through the opening 46 and larger than the diameter of the detent 48 so that chain 40 is securable to the handle 26 simply by positioning two balls of the chain above and below the detent. Thus, the plate 44 with its opening 46 and detent 48 services as a locking means for the chain 40. The chain 40 in turn serves as a force exerting means for the lower sections 22 of the strip elements 20, whereby the lower sections may be expanded radially upwardly and outwardly in the manner shown in FIG. 6 by pulling upwardly on the chain. When the strip elements 20 are in the position shown in FIG. 6 the chain 40 may be shifted from the opening 46 into detent 48 and locked in place thereby locking the strip elements 20 in place so that the device 10 may be rotated to clean the interior of the container 12.

Figure 6:
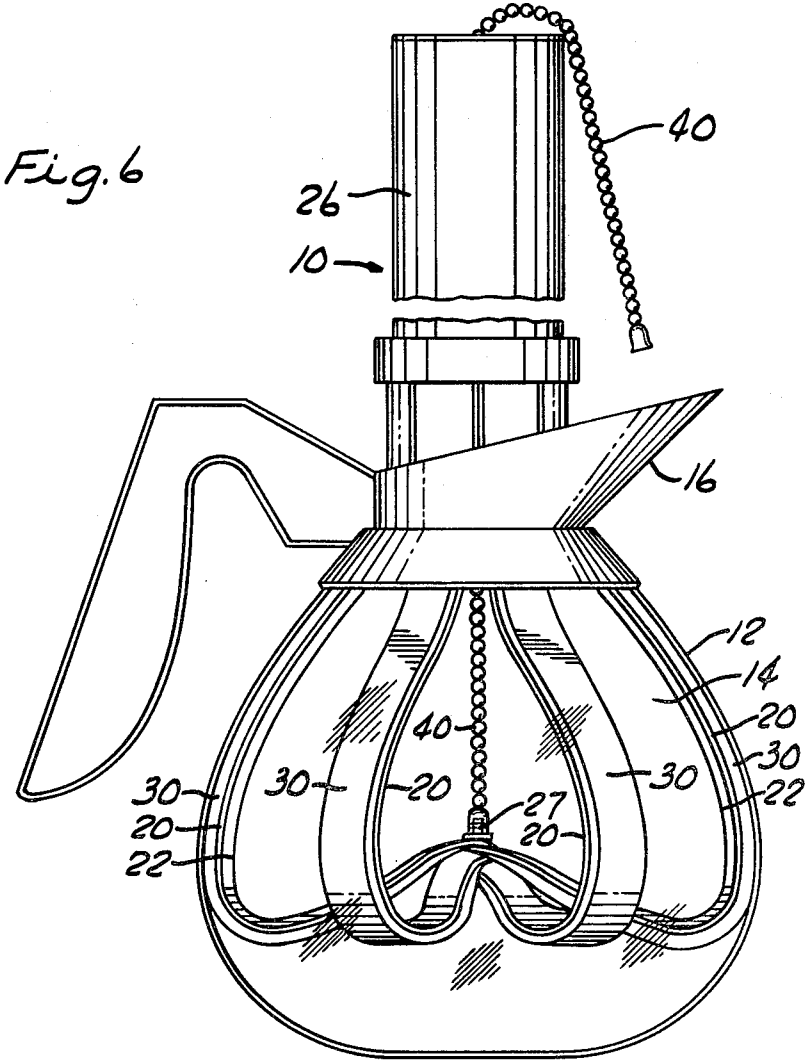
FIG. 6 is an elevation view similar to FIG. 5 showing the top portions of the lower sections of the strip elements expanded radially outwardly and upwardly into engagement with the upper portion of the main vessel.
Figure 5:
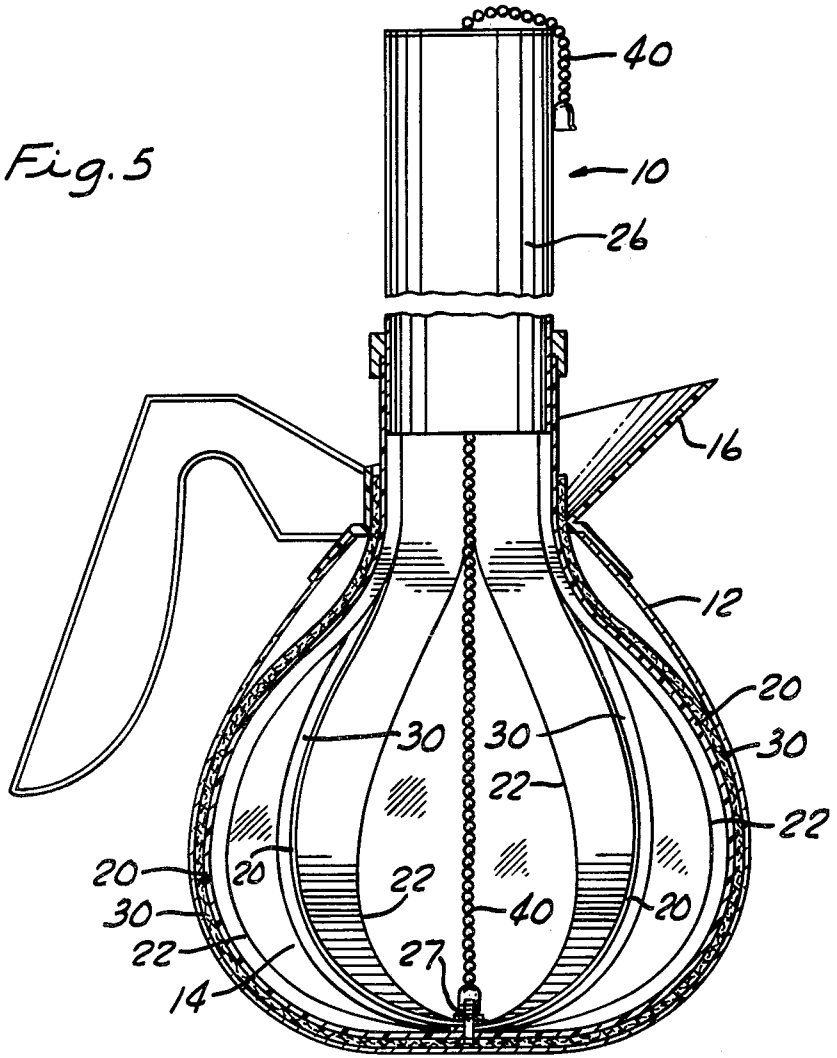
FIG. 5 is an elevation view of the device of FIG. 1 shown within a coffee container with the lower sections of the strip elements expanded into engagement with the bottom and lower section of the main vessel, and with the neck of the container being cut away to show the engagement of the lower sections of the strip with the interior of the neck.

The operation of the cleaning device 10 should be readily apparent. The strip elements 20 are resilient to the extent that the lower sections 22 thereof compress or collapse radially inwardly sufficiently to allow the lower section 22 to be easily inserted into the main vessel 14. Once within the main vessel a downwardly directed force is exerted on the strip elements 20 whereby the lower sections 22 expand radially outwardly to engage the bottom of the main vessel 14 and most of the rest of its interior except for part of its upper section. The chain 40 would then be pulled up into tension sufficient to hold the lower sections 22 of the strip elements 20 in their orientation shown in FIG. 5. The chain 40 would then be locked in place within the end plate 44. At that point the device 10 would be rotated about its longitudinal axis to scrub or wipe clean most of the interior of the vessel 14. It is also to be noted that the lower sections 22 of the strip elements 20 are long enough to extend through the neck section 16 of the container 14 as shown in FIG. 5 so that the neck section is cleaned simultaneously with cleaning the main vessel 14. As described in the preceding paragraph exerting an upwardly directed force on the chain 40 will expand the lower sections 22 of the strip elements 20 to engage the upper section of the main vessel 14 as shown in FIG. 6. After the chain 40 is locked in place the device 10 may be rotated whereby the upper section of the vessel 14 will be cleaned. After the interior of the container 12 is completely cleaned the chain 40 would be unlocked relieving the pressure on the strip elements 20 and the device 10 simply pulled out of the container 12.

It should now be clearly appreciated that the cleaning device of this invention is both efficient in its cleaning capabilities and simple in its structure. Those skilled in the art should also readily realize that various design modifications are possible with the overall design of this invention. For example, the strip elements may be formed such that there is a common lower portion as compared with the oveerlapping joined construction described. Also, the upper sections of the strip elements could be joined without the need of a separate handle.

While I have shown and described a certain present preferred embodiment of this invention, it is to be distinctly understood that the invention is not limited thereto, but may be otherwise embodied within the scope of the following claims.

I claim:

1. A device for cleaning containers having an upper opening and neck section, and an enlarged generally spheroidally shaped main vessel, the device comprising:

a plurality of elongated resilient strip elements the lower sections of which being longitudinally curved and the upper sections being generally straight, said strip elements being constructed and arranged with respect to each other such that their respective upper sections form a generally tubular pattern and the lower sections form a generally bubble-shaped pattern;

scouring means on at least the outer surfaces of the lower portions of said strip elements;

force exerting means operable between the upper and lower sections of said strip elements for transmitting an upwardly directed force on the lower sections to expand the top portions of lower sections in a radially outwardly and upwardly direction;

locking means for locking said force exerting means in differing positions relative to the upper section of said strip elements; and whereby said strip elements, force exerting means, and locking means are constructed and arranged with respect to each other such that the lower section of said strip elements will compress radially inwardly to allow entry thereof into the vessel and when a downwardly directed force is applied to said strip elements the lower sections expand radially outwardly to engage the neck section of a container, bottom surface, and at least the lower sections of the main vessel, and when an upwardly directed force is transmitted through said force exerting means to the lower sections of said strip elements the top portions of the lower sections expand radially outwardly and upwardly to engage the upper portions of the vessel, with said force exerting means securable to said locking means for holding said strip elements in any desired pattern within the vessel so that said strip elements may be rotated to clean the inside of the container.

2. A device for cleaning containers as set forth in claim 1 wherein said securing means includes a tubular member shaped to be grasped by a hand of a user.

3. A device for cleaning containers as set forth in claim 1 wherein force exerting means includes an elongated member with one end fixed to said holding means and the other end extending outwardly of the upper ends of the upper sections of said strip elements.

4. A device for cleaning containers as set forth in claim 1 wherein said strip elements are formed from a non-metallic material.

5. A device for cleaning containers as set forth in claim 1 wherein said scouring means are separate elements secured to the outer surfaces of the lower portions of said strip elements.

6. A device for cleaning containers as set forth in claim 1 including securing means for securing the upper sections of said strip elements in the generally tubular pattern.

7. A device for cleaning containers as set forth in claim 1 including holding means for fixing the lower ends of said strip elements and for holding the lower sections of said strip elements in the generally bubble-shaped pattern.

* * * * *